United States Patent [19]

Childs et al.

[11] 4,254,385

[45] Mar. 3, 1981

[54] TWO-DIMENSIONAL (PLANAR) TDMA/BROADCAST MICROWAVE SWITCH MATRIX FOR SWITCHED SATELLITE APPLICATION

[75] Inventors: William H. Childs, Gaithersburg, Md.; Christoph E. Mahle, Washington, D.C.

[73] Assignee: Communications Satellite Corporation, Washington, D.C.

[21] Appl. No.: 938,572

[22] Filed: Aug. 31, 1978

[51] Int. Cl.[2] ..... H01P 1/15

[52] U.S. Cl. ..... 333/104; 333/116; 333/164

[58] Field of Search ..... 333/101, 104, 115, 116, 333/109, 161, 164

[56] References Cited

U.S. PATENT DOCUMENTS

| | | | |
|---|---|---|---|
| 3,559,108 | 1/1971 | Seidel | 333/109 X |
| 3,931,599 | 1/1976 | Salzberg | 333/164 |
| 3,967,220 | 6/1976 | Tagashira et al. | 333/109 X |
| 3,996,533 | 12/1976 | Lee | 333/101 X |

FOREIGN PATENT DOCUMENTS

| | | | |
|---|---|---|---|
| 1942279 | 2/1970 | Fed. Rep. of Germany | 333/101 |

*Primary Examiner*—Paul L. Gensler

*Attorney, Agent, or Firm*—Sughrue, Rothwell, Mion, Zinn and Macpeak

[57] ABSTRACT

A planar microwave switch matrix is composed of three-state phase shifter switches, a planar crossover and switchable 3-dB attenuators. The three-state phase shifter switches are each composed of two planar 3-dB quadrature hybrid couplers interconnected by two switchable phase shifters. The phase shifters are both switchable between zero phase delay and a predetermined phase delay, but the predetermined phase delay is different for each phase shifter. The planar crossover is composed of two cascaded 3-dB quadrature hybrid couplers. The construction of all components of the switch matrix is readily implemented using microwave integrated circuit (MIC) technology. The switch matrix is intended for use in switched satellite time division multiple access (SS-TDMA) systems but can be remotely configured for broadcast applications.

9 Claims, 7 Drawing Figures

| MODE | $\varphi_1-\varphi_2$ | SCATTERING MATRIX (NON-ZERO TERMS) | SCHEMATIC |
|---|---|---|---|
| CROSSOVER | 0 | $\begin{bmatrix} b_3 \\ b_4 \end{bmatrix} = e^{-j(\pi/2+\varphi_2)} \begin{bmatrix} 0 & 1 \\ 1 & 0 \end{bmatrix} \begin{bmatrix} a_1 \\ a_2 \end{bmatrix}$ | 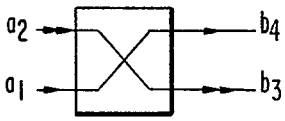  |
| STRAIGHT THROUGH | $\pm\pi$ | $\begin{bmatrix} b_3 \\ b_4 \end{bmatrix} = e^{-j\varphi_2} \begin{bmatrix} -1 & 0 \\ 0 & 1 \end{bmatrix} \begin{bmatrix} a_1 \\ a_2 \end{bmatrix}$ | 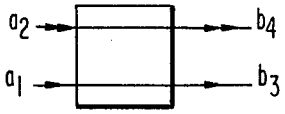  |
| BROADCAST MODE | $\pm\pi/2$ | $\begin{bmatrix} b_3 \\ b_4 \end{bmatrix} = \frac{e^{-j\varphi_2} e^{-j\pi/2} e^{\mp j\pi/4}}{\sqrt{2}} \begin{bmatrix} \pm 1 & 1 \\ 1 & \mp 1 \end{bmatrix} \begin{bmatrix} a_1 \\ a_2 \end{bmatrix}$ | 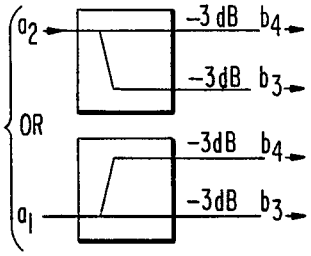  |

FIG. 4

FIG. 5

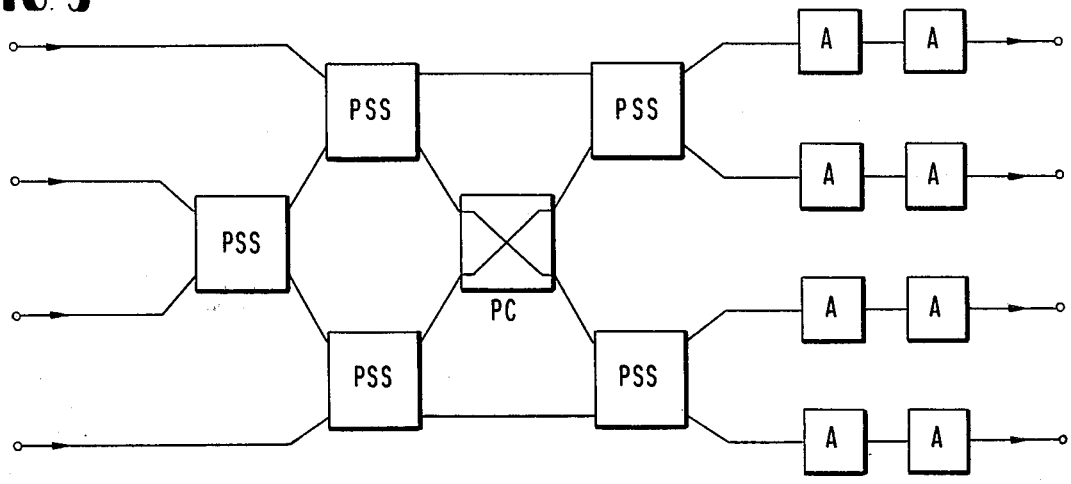

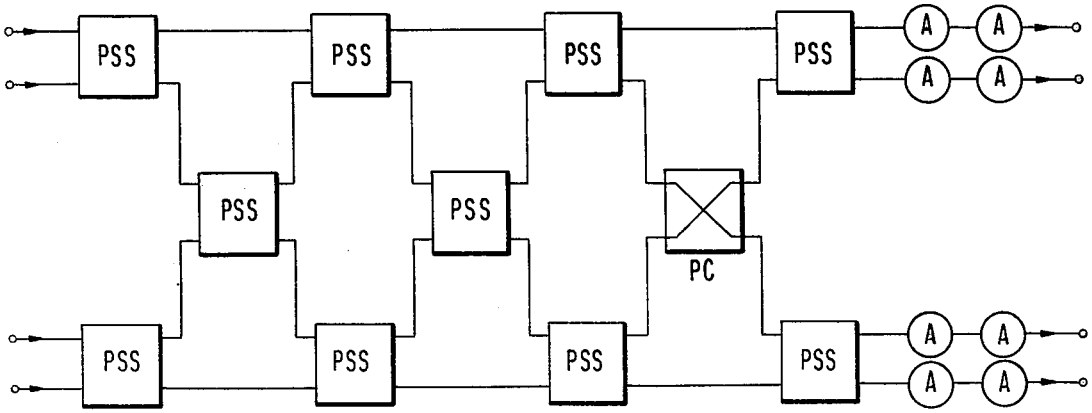

FIG. 6

TWO-DIMENSIONAL (PLANAR) TDMA/BROADCAST MICROWAVE SWITCH MATRIX FOR SWITCHED SATELLITE APPLICATION

BACKGROUND OF THE INVENTION

The present invention generally relates to microwave switches and switch matrices and, more particularly, to a planar switch matrix composed of elements which can be readily implemented using MIC technology. The disclosed switch can realize all TDMA modes and, in addition, can provide broadcast modes of switch (one input to m outputs). The switch matrix is realized in a single plane.

Microwave switching arrangements have generally taken the form of an array of electromechanical switches, by necessity non-planar, connected by cables or a switchable power divider/combiner arrangement. Owing to the complexity of their design, these arrangements have several disadvantages, including problems in producibility, reliability, space and weight.

More recent efforts have taken the form of crossbar switches. The switch element is a simple on/off arrangement using PIN diodes or field effect transistors. The crossbar switch requires a 3-dimensional realization with attendant problems of reliability and producibility.

In satellite communication systems, there is a continuing effort to improve the reliability while at the same time reducing both the size and weight of system components. It is also desirable to improve the producibility of components from the point of view of cost, but often improvements in producibilty and reliability are the direct result of one another. In other words, simpler components are often more reliable.

Because of the inaccessibility of a communications satellite after launch, the design of such systems attempts to take into account the various traffic patterns that may be expected. For this reason, microwave switching arrangements are typically used in SS-TDMA systems. However, even greater flexibility would be advantageous under some traffic requirements. Specifically, in some cases, it would be desirable to remotely configure the satellite system for broadcast applications as well as TDMA.

SUMMARY OF THE INVENTION

It is therefore an object of this invention to reduce a microwave switching matrix to an integrated, planar form, thereby achieving significant improvements over the prior art microwave switching arrangements.

This is accomplished by using three basic components in the switch matrix, all of which are readily implemented using MIC technology. The three components are a threestate phase shifter switch, a planar crossover and a switchable 3-dB attenuator. The threestate phase shifter switch is composed of two 3-dB quadrature hybrid couplers interconnected by two switchable phase shifters. The phase shifters are both switchable between zero phase delay and a predetermined phase delay, but the predetermined phase delay is different for each phase shifter. The planar crossover is composed of two cascaded 3-dB quadrature hybrid couplers.

When operated in the pure TDMA mode, power dissipation through the matrix is negligible. Power loss when operated in the broadcast mode is similar to the divider/combiner matrix of the prior art. Because the switch matrix according to the invention is two-dimensional instead of three-dimensional, significant savings in weight, space, producibility and reliability are realized. Moreover, the use of MIC technology results in significant improvements in producibility and reliability.

BRIEF DESCRIPTION OF THE DRAWINGS

The invention will be better understood from the following detailed description with reference to the accompanying drawings, in which:

FIG. 4 is a table showing the properties of the threestate phase shifter shown in FIG. 3;

FIG. 5 is a switch matrix using phase shifter switches for TDMA and/or broadcast connections; and FIG. 6 is another switch matrix which connects all TDMA and broadcast modes.

DETAILED DESCRIPTION OF THE INVENTION

Figure 1A:
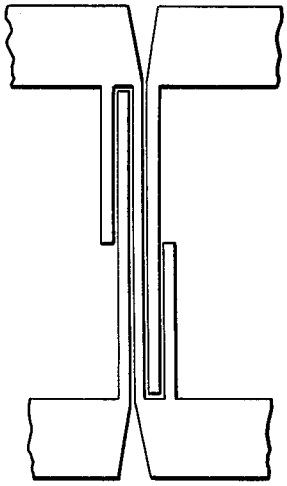
FIG. 1A is a plan view of the metalized pattern of a 3-dB interdigitated quadrature coupler used to implement a phase shifter switch according to the invention.

One of the basic elements used in the invention is a planar 3-dB quadrature hybrid coupler of the type generally depicted in FIG. 1A. This is an interdigitated strip line quadrature hybrid comprising a metalized pattern generally as shown on a dielectric substrate. The theory and operation of such hybrids are described in an article by J. Lange, entitled "Interdigitated Stripline Quadrature Hybrid," published in *IEEE Transactions on Microwave Theory and Techniques,* Volume MTT-17, December 1969, pages 1150–1151. These hybrids have been typically manufactured using high-dielectric substrates, such as alumina. Recently, low-dielectric substrates, such as fused silica, have been used as described by William H. Childs and Peter A. Carlton in an article entitled "A 3-dB Interdigitated Coupler on Fused Silica," published in the 1977 *IEEE MTT Digest.* The advantage of using low-dielectric substrates is that a significant reduction in substrate thickness can be realized at no sacrifice in loss; therefore, the preferred embodiment of the invention is fabricated using MIC technology on low-dielectric substrates.

Figure 1B:
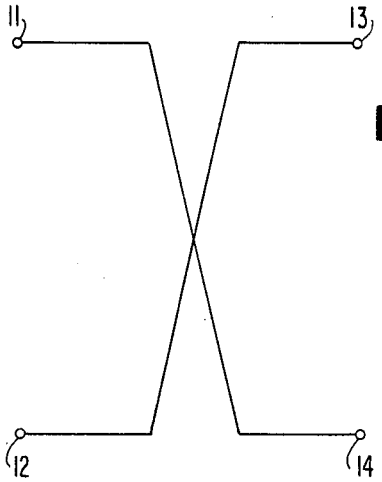
FIG. 1B is a schematic representation of the coupler shown in FIG. 1A.

In subsequent figures, the 3-dB hybrid coupler will be schematically represented as shown in FIG. 1B. As in all quadrature hybrid couplers, this is a four-port network having two input terminals 11 and 12 and two output terminals 13 and 14. Power supplied to input terminal 11, for example, is equally divided between output terminals 13 and 14, but the power at output terminal 14 is delayed in phase by 90°, whereas there is no delay at output terminal 13. Thus, for an input power $P_i$ at terminal 11, the output power $P_o$ at terminals 13 and 14 can be expressed as follows:

$P_o$ (terminal 13) $= -3$ dB $P_i = 0°$ $P_o$ (terminal 14) $= -3$ dB $P_i = 90°$ A similar analysis can be made of the power division between output terminals 13 and 14 for power applied to input terminal 12, but in this case, the phase delay occurs at output terminal 13 instead of output terminal 14. The scattering matrix for the 3-dB quadrature coupler is set forth below, it being realized, of course, that the device is reciprocal:

$$\frac{1}{\sqrt{2}}\begin{bmatrix} 0 & 0 & 1 & e^{-j\pi/2} \\ 0 & 0 & e^{-j\pi/2} & 1 \\ 1 & e^{-j\pi/2} & 0 & 0 \\ e^{-j\pi/2} & 1 & 0 & 0 \end{bmatrix}$$

Figure 2:
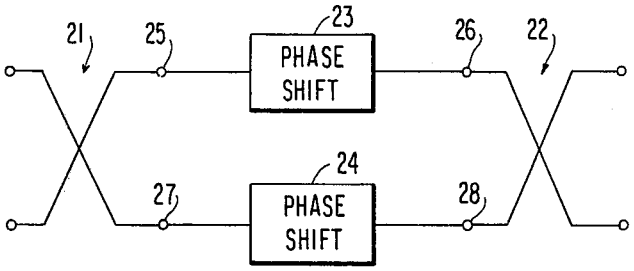
FIG. 2 is a schematic representation of the basic form of the phase shifter switch of the invention.

The principal component of the switch matrix according to the invention is a three-state phase shift switch as shown in FIG. 2. This switch is composed of input and output couplers 21 and 22, respectively, interconnected by phase shifters 23 and 24. More specifically, phase shifter 23 is connected between output terminal 25 of hybrid 21 and input terminal 26 of hybrid 22, while phase shifter 24 is connected between output terminal 27 of hybrid 21 and input terminal 28 of hybrid 22. Phase shifter 23 has a phase shift $\phi_1$ which is switchable between 0 and $\pi$, and phase shifter 24 has a phase shift $\phi_2$ which is switchable between 0 and $\pi/2$. The scattering matrix for the phase shifters is as follows:

$$\begin{bmatrix} 0 & e^{-j\phi} \\ e^{-j\phi} & 0 \end{bmatrix} \quad i = 1, 2$$

Therefore, the scattering matrix for the phase shifter switch (PSS), as shown in FIG. 2, is given by the following expression:

$$\frac{e^{-j\phi 2}}{2}\begin{bmatrix} 0 & 0 & (e^{-j(\phi 1-\phi 2)}-1) & e^{-j\pi/2}(e^{-j(\phi 1-\phi 2)}+1) \\ 0 & 0 & e^{-j\pi/2}(e^{-j(\phi 1-\phi 2)}+1) & -(e^{-j(\phi 1-\phi 2)}-1) \\ (e^{-j(\phi 1-\phi 2)}-1) & e^{-j\pi/2}(e^{-j(\phi 1-\phi 2)}-1) & 0 & 0 \\ e^{-j\pi/2}(e^{-j(\phi 1-\phi 2)}+1) & -(e^{-j(\phi 1-\phi 2)}+1) & 0 & 0 \end{bmatrix}$$

There are three important values of the quantity $(\phi_1-\phi_2)$. These are $\phi_1-\phi_2=0, \pm\pi, \pm\pi/2$. The case where $\phi_1-\phi_2=0$ or $\pm\pi$ corresponds to application as a "C" switch. The case of $\phi_1-\phi_2=\pm\pi/2$ corresponds to application as a broadcast mode switch. These properties and the associated scattering matrices are tabulated in FIG. 4.

Figure 3:
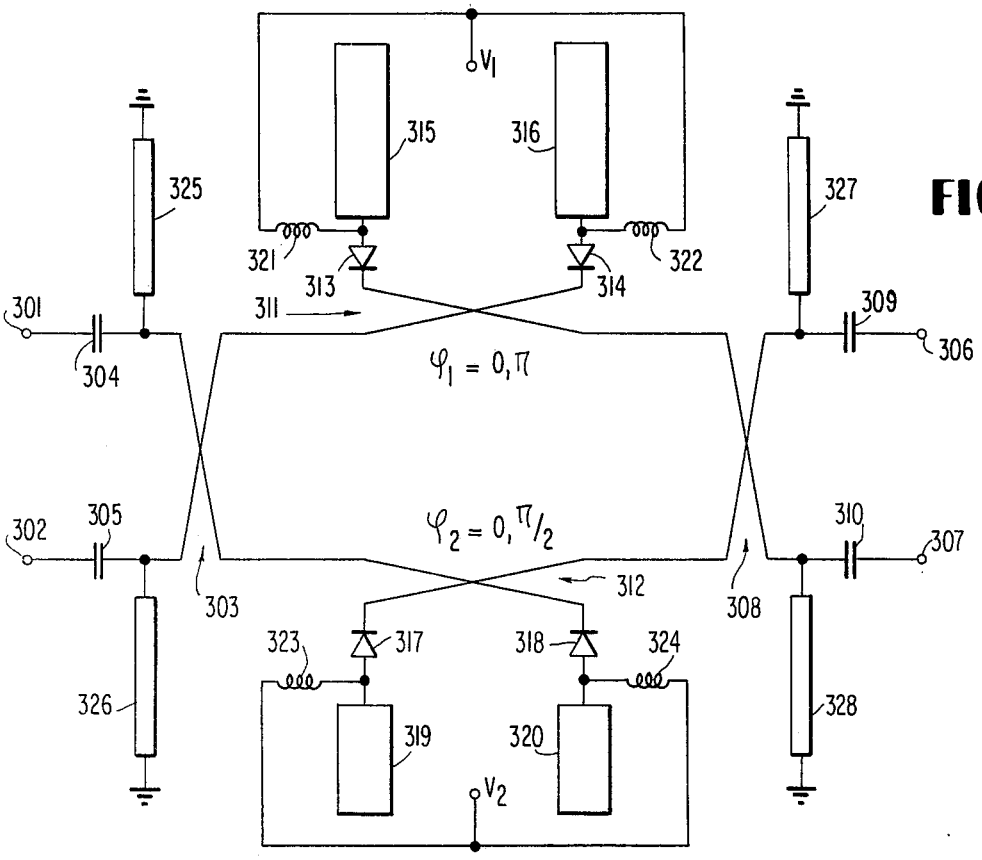
FIG. 3 is a more detailed illustration of the phase shifter switch showing the implementation of the phase shifters using a quadrature coupler and diode switched reactances.

A practical MIC implementation of the switch of FIG. 2 is shown in FIG. 3. The input terminals 301 and 302 of the switch are connected to the input hybrid coupler 303 by means of bypass capacitors 304 and 305, respectively. Similarly, the output terminals 306 and 307 of the switch are connected to the output hybrid coupler 308 by means of bypass capacitors 309 and 310, respectively. The bypass capacitors are preferably of the beam lead MOS type. One output of hybrid 303 is connected to one arm of a first phase shifter hybrid 311, while the other output of hybrid 303 is connected to one arm of a second phase shifter hybrid 312. Hybrids 311 and 312 are both 3-dB interdigitated quadrature couplers like hybrids 303 and 308, and are connected to the inputs of hybrid 308 in mirror image to their connections to hybrid 303. For convenience, the connections of hybrids 311 and 312 to hybrids 303 and 308 will be referred to as the inputs to hybrids 311 and 312, but those skilled in the art will understand that, owing to the reciprocity of these devices, the terms "inputs" and "outputs" may be interchanged.

The outputs of hybrid 311 are connected through switching diodes 313 and 314 to open circuit stubs 315 and 316, respectively. Similarly, the outputs of hybrid 312 are connected through switching diodes 317 and 318 to open circuit stubs 319 and 320. Stubs 315 and 316 are of equal lengths as are stubs 319 and 320, but stubs 315 and 316 have different lengths than stubs 319 and 320. The lengths of the open circuit stubs are selected to provide phase shifts shown in Table 1 below and as indicated in FIG. 3. Specifically, stubs 315 and 316 are approximately $\lambda/4$, and stubs 319 and 320 are approximately $\lambda/8$, where $\lambda$ is the wavelength of the center frequency of the switch.

TABLE 1

| $\Phi_1-\Phi_2$ As A Function Of Diode States | | |
|---|---|---|
| diodes 313 and 314 | diodes 317 and 318 | $\Phi_1-\Phi_2$ |
| off | off | 0 |
| on | off | $\pi$ |
| off | on | $-\pi/2$ |
| on | on | $+\pi/2$ |

Switching of the diodes is accomplished by means of two bias voltage sources. A bias voltage $V_1$ is connected by means of respective bias filters (RFC) 321 and 322 to the anodes of diodes 313 and 314, and a bias voltage $V_2$ is connected by means of respective bias filters 323 and 324 to the anodes of diodes 317 and 318. The bias filters may be simple two-terminal low-pass filters. The bias current to the switching diodes is returned by means of high impedance $\lambda/4$ lines 325, 326, 327 and 328 connected to the input and output arms, respectively, of hybrids 303 and 308. When the diodes are back biased, there is no phase shift; however, when the diodes are forward biased, a phase delay is produced according to the lengths of the open circuit stubs.

The simple cascade of two interdigital couplers (corresponding to $\phi_1-\phi_2=0$ in the PSS) allows a planar crossover (PC) of two transmission lines. The third component used in the microwave switch matrix according to the invention is a 0- or 3-dB switchable attenuator (A) which may be of any well-known microstrip design using PIN diode switches or latching circulators.

A minimum realization of a 4×4 TDMA switch matrix is shown in FIG. 5 as an example. Redundant paths can be provided with additional phase shifter switches and planar crossovers. The three state PSS's allow broadcast operation by the addition of switchable 3-dB attenuators (A) at the output in order to equalize output levels. FIG. 6 shows an arrangement for switching all TDMA and broadcast modes of a 4×4 matrix. Extension to the general n×n case is obvious.

The PSS's would be constructed on individual substrates as indicated in FIG. 3. After testing, they would be assembled into an integrated switch matrix as shown in FIG. 5. Individual substrates could be mounted on individual carries that could be attached to the switch matrix floor with screws. Substrates would be adjacent to one another, and the interconnections could be made with gold ribbon. A particular PSS that failed or did not perform as anticipated could be removed, repaired or replaced readily. After RF integration had been completed, attenuator states would be set with a logic array dependent on the commands given the switch matrix. By induction, it is apparent that larger arrays can be realized with the same techniques. The number of 3-dB attenuators depends on the number of possible power divisions; for example, a $5\times5$ matrix would require three cascaded attenuators in each output line.

n inputs can be connected to each of n outputs in n factorial ways. The switching matrix according to the invention performs this function with negligible power loss and acceptable levels of cross talk. This switching is accomplished with the $\phi_1-\phi_2=0$, $\pi$ modes of the PSS. In addition, the switching matrix according to the invention allows the broadcast mode of switching. This is, for n inputs and n outputs, any one input can be connected to m outputs where 1 is $\leqq$m which is $\leqq$n. In this mode, power division is accomplished with the $\phi_1-\phi_2=\pm\pi/2$ mode of the PSS. The $\phi_1-\phi_2=0$, $\pi$ modes of the PSS would be used for routing to the appropriate output lines. A PSS in the $\pi/2$ mode causes power division by 2 (FIG. 4); the switchable 3-dB attenuators on the output lines would be used to equalize output powers. Unused input and output lines would be terminated in their match impedance.

There are n to the n power ($n^n$) ways of connecting all TDMA and broadcast modes in an $n\times n$ matrix. The techniques according to this invenion allow all $n^n$ TDMA and broadcast connections to be realized. The particular implementation that would be chosen would depend on the reliability requirements (i.e., the desired number of redundant paths) and the desirability of having all $n^n$ connections.

What is claimed is:

1. A planar microwave phase shifter switch comprising:

an input planar 3-dB quadrature hybrid coupler and an output planar 3-dB quadrature hybrid coupler, each of said couplers having first and second inputs and first and second outputs; and a first switchable phase shifter connected between the first output of said input hybrid coupler and the first input of said output hybrid coupler, and a second switchable phase shifter connected between the second output of said input hybrid coupler and the second input of said output hybrid coupler, said first phase shifter being switchable between zero and $\pi$ phase delay, and said second phase shifter being switchable between zero and $\pi/2$ phase delay.

2. A planar microwave phase shifter switch as recited in claim 1 wherein said input and output hybrid couplers are interdigitated microstrip quadrature hybrids.

3. A planar microwave phase shifter switch as recited in claim 1 wherein each of said first and second phase shifters comprise a planar 3-dB quadrature hybrid coupler having first and second inputs and first and second outputs, said first input being connected to an output of said input hybrid and said second input being connected to an input of said output hybrid, and two identical switched reactances connected to said first and second outputs.

4. A planar microwave phase shifter switch as recited in claim 3 wherein said reactances are opencircuited stubs.

5. A planar microwave switch matrix having n inputs and n outputs wherein any one input can be connected to m outputs where $1\leqq m\leqq n$ comprising an array of interconnected planar microwave phase shifter switches wherein each of said switches comprise:

an input planar 3-dB quadrature hybrid coupler and an output planar 3-dB quadrature hybrid coupler, each of said couplers having first and second inputs and first and second outputs; and a first switchable phase shifter connected between the first output of said input hybrid coupler and the first input of said output hybrid coupler, and a second switchable phase shifter connected between the second output of said input hybrid coupler and the second input of said output hybrid coupler, said first phase shifter being switchable between zero and $\pi$phase delay, and said second phase shifter being switchable between zero and $\pi/2$ phase delay.

6. A planar microwave switch matrix as recited in claim 5 further comprising at least one planar crossover included in said array of interconnected planar microwave phase shifter switches, said planar crossover comprising a plurality of 3-dB quadrature hybrid couplers connected in cascade.

7. A planar microwave switch matrix as recited in claim 6 further comprising one or more planar 0- or 3-dB switchable attenuators connected in series to each of said n outputs.

8. A planar microwave switch matrix as recited in claim 7 wherein each of said phase shifter switches, said crossover and said attenuators are microstrip circuits.

9. A planar microwave switch matrix as recited in claim 8 wherein each of said 3-dB quadrature hybrid couplers are interdigitated microstrip quadrature hybrids.

* * * * *

UNITED STATES PATENT AND TRADEMARK OFFICE

CERTIFICATE OF CORRECTION

PATENT NO. : 4,254,385

DATED : March 3, 1981

INVENTOR(S) : William Henry Childs et al.

It is certified that error appears in the above—identified patent and that said Letters Patent is hereby corrected as shown below:

IN THE SPECIFICATION:

Column 1, line 11, delete "switch" insert --switching--;

Column 1, line 55, delete "threestate" insert --three-state--;

Column 4, line 63, delete "three state" insert --three-state--;

Column 5, line 5, delete "carries" insert --carriers--;

Column 5, line 24, delete "This" insert --That--;

IN THE CLAIMS:

Claim 4, line 2, delete "opencircuited" insert --open-circuited--.

Signed and Sealed this

Ninth Day of June 1981

[SEAL]

Attest:

RENE D. TEGTMEYER

Attesting Officer

Acting Commissioner of Patents and Trademarks